US006535099B1

(12) United States Patent
Hernandez Cruz

(10) Patent No.: US 6,535,099 B1
(45) Date of Patent: Mar. 18, 2003

(54) CORES AND COILS FOR ELECTRICAL TRANSFORMERS

(76) Inventor: Alfonso Hernandez Cruz, Isabel la Catolica 626, Irapuato, Guanajuato (MX)

( * ) Notice: Subject to any disclaimer, the term of this patent is extended or adjusted under 35 U.S.C. 154(b) by 0 days.

(21) Appl. No.: 09/673,130

(22) PCT Filed: Apr. 13, 1998

(86) PCT No.: PCT/MX98/00014

§ 371 (c)(1),
(2), (4) Date: Nov. 13, 2000

(87) PCT Pub. No.: WO99/53507

PCT Pub. Date: Oct. 21, 1999

(51) Int. Cl.[7] ..... H01F 27/24

(52) U.S. Cl. ..... 336/213; 336/212; 336/234; 336/180

(58) Field of Search ..... 336/213, 217, 336/197, 195, 212, 180, 234, 229

(56) References Cited

U.S. PATENT DOCUMENTS 2,960,756 A 11/1960 Treanor
3,267,557 A 8/1966 Olsen et al.
4,283,842 A * 8/1981 DeLaurentis et al. ..... 29/606
4,504,813 A 3/1985 Stang
4,547,721 A 10/1985 Drapp
4,789,849 A 12/1988 Ballard et al.
4,993,141 A * 2/1991 Grimes et al. ..... 29/606
5,210,930 A * 5/1993 Watabe et al. ..... 29/606
5,353,494 A 10/1994 Bisbee et al.

* cited by examiner

*Primary Examiner*—Anh Mai
(74) *Attorney, Agent, or Firm*—Birch, Stewart, Kolasch & Birch, LLP

(57) ABSTRACT

The present invention relates to cores and coils for electrical transformers in which lateral walls of either Wescore or toroidal type cores are manufactured by winding strips of different heights or only one strip whose width reduces gradually, so that the lateral walls form an angle relative to the core upper wall. The corresponding coil is manufactured following the core pattern, on which core the coil will be placed or wound. The use of the cores and coils of the present invention achieves substantial savings in materials used to manufacture electrical transformers, while the resulting characteristics and electrical losses are improved, with load and with no-load.

11 Claims, 12 Drawing Sheets

CORES AND COILS FOR ELECTRICAL TRANSFORMERS

This application is the national phase under 35 U.S.C. §371 of PCT International Application Ser. No. PCT/MX98/00014 which has an International filing date of Apr. 13, 1998, which designated the United States of America.

BACKGROUND OF THE INVENTION

A number of electrical transformers are known which transfer electrical energy by induction from one or more circuits to one or more circuits, at the same frequency and accomplishing usually a transformation in the voltage and current values.

Single-phase transformers are built with one coil and two cores or two coils and one core, and three-phase transformers are built with three coils and three or four cores. The purpose is to close electrical and magnetic circuits within the core and the coil, respectively; this type of transformer being the one most commonly used in industry.

The transformer core is built from magnetic steel, usually grain-oriented silicon steel, of different thicknesses, coatings and qualities. The greater the quality of core materials, the lesser are electrical losses.

Core losses are known as "empty" or "no-load" losses, since they are always present while the transformer is connected to electrical lines, regardless of whether there is or is not a load. These losses are measured in watts.

The coil manufacturing process consists in winding from several to thousands of turns of copper or aluminum wires or leads, either in the form of strip, of rectangular or round cross section, all of them with or without insulation. The common practice consists in winding first a low voltage conductor and thereafter one of high voltage, always observing the laws and traditional principles of the calculation of transformers and electrical machines. Traditional coil arrangements include schemes such as those of low voltage—high voltage and low voltage—high voltage—low voltage, depending on the needs of transformation required by the final user.

In transformer design, traditional electricity and magnetism formulas and criteria are used such as:

- The transformation ratio, which results from the number of turns of the high voltage section (primary) to the number of turns of the low voltage section (secondary);
- The wire's current capacity, in amperes per square millimeter;
- The electromagnetic induction caused by the turns of conductors on the core cross section, measured in teslas;
- The impedance in percentage caused by resistance of the conductors, in ohms; and
- The transformer excitation current, characteristic of the core material and construction pattern.

On the other hand, transformers are manufactured with a voltage regulating section to adjust the voltage of transmission lines to the voltage required by the final user, known as the tap changer section, which can change the output voltage in a ±5% or any other specified percentage.

Transformers are placed within a steel tank following the geometry of each construction, so that for single-phase transformers, the tank is generally round in cross section and for three-phase transformers the tank cross section is generally rectangular. Additionally, tanks are fitted with a series of accessories such as high voltage bushings, low voltage bushings, tap changer, ground plate or bolt, a combination of oil drain and lower filter valve, pressure bleeder and relief valve, overhead connection for leak test, transformer lifting hooks, name plate with the serial number and cooling radiators, as is well known in the art.

Depending on the user needs, there are self-protected transformers, both in high and low voltage, therefore accessories are added such as fuses, breakers, fault indicative lights, etc.

Another type of transformer is known as padmount type, which contains the same above described components. The basic difference between these transformers is the tank form and the additional guard and control accessories normally added. Generally, these transformers are used in termination of lines (radial feed) and in networks with line continuation (loop feed).

Transformers are required to comply with a series of laboratory tests and construction criteria, i.e., they should meet or fulfill various Mexican and International standards or norms. Within the main applicable standards in this field, there can be mentioned the Mexican standards NMX J 116, NMX J 285, NMX J 284, NMX J 169; of the United States of America ANSI C 57 12.00 (1993), NEMA MW 1000; Canadian CSA: CS M91, C 227.1, C227.2, C 227.3, C 227.4, C 301.1 and C2 M91; and International IEC Publication 76 (1993).

In order to make economic comparisons among transformers, the transformer sales price must be taken into account and the indices of Power Utilities or Electricity Companies on the electricity generation cost per Kilowatt (KW), In this way, the Evaluated Price is obtained by adding the transformer sales price plus the no-load losses cost and the load losses cost, according to the following formula:

Evaluated Price=Transformer price+$No-load Losses+$Load Losses, wherein:

$No-load Losses=Index v×No-load Losses $Load Losses=Index c×Load Losses

Typically indices used in the world are $USD 2.00 per watt of load, index c, and $USD 4.00 per watt of no-load loss, index v.

Procurement of transformers by power utilities or electrical companies is generally done by means of bidding, in which the manufacturer that has the smallest evaluated price is certainly the one who is designated as the supplier.

For many years, development in transformer design has been directed only to the improvement of construction materials in themselves. Regarding the cores, there exists better silicon steel strip; concerning electrical insulation materials, power factor and voltage resistance test Characteristics have been improved through additives and resins.

Currently, the most outstanding development in materials has been the invention of amorphous steel, which reduces up to 80% the normal no-load losses; however this great advantage is diminished for the following reasons:

- Thickness hardly reaches 0.10 mm (0.004"), so the core manufacturing constitutes one of the most important problems to solve;
- The stacking factor is of 82% maximum, while in silicon steel it is about 97%;
- The magnetic saturation upper limit is of 13.5 teslas against 17 teslas of silicon steel;
- It has less density than silicon steel, i.e., 7.18 g/cm$^3$ against 7.65 g/cm$^3$; and
- The difference in price for steels is of $USD 1.80 per kilogram of silicon steel against $USD 4.08 per kilogram of amorphous steel.

Referring now to cores, the material used in their construction is typically grain-oriented silicon steel sheet, in different thicknesses, basically consisting of a low carbon iron-silicon alloy and coated on both faces with an insulating material known as "Carlite" or with glass fiber. Currently there are three principal types of cores: the Wescore core, the cruciform core and the toroidal type core.

The Wescore core was originally developed by Westinghouse in the sixties. This type of core permits large production volumes since there are generic machines available in the market. This type of core is found generally either in pole type and substation type single-phase or three-phase transformers. This type of core is also known as "Distributed Air-Gap Wound Core".

The Wescore core is formed from a wound steel strip in a continuous form to which sequential cuts are realized in order to allow it to be disassembled and reassembled around the coil. In other words, coils and cores are manufactured in two separate processes, the core being reassembled thereafter on the coil thanks to the cuts realized on the core sheets. The cross section of this type of core is generally rectangular. The foregoing allows a high volume of production. The maximum voltage recommended for transformers manufactured with this type of core is about 69,000 volts and up to 3000 KVA, if it is a shell-type transformer.

On the other hand, the toroidal-type core is formed from a steel strip wound in continuous circular form, without cuts. The conductors are wound around the core, also forming a toroid. This pattern allows the core magnetic path and the winding electrical path to be kept closer, and in the core no losses exist due to cuts, for example, as those found in the Wescore core. The result of using a toroidal-type core is an efficient transformer with a dramatic reduction in total losses. To a greater extent, advantages of toroidal-type core transformers are, among others, low core losses, lower noise level, lower telephonic interference, greater support in short circuit and excellent thermal characteristics.

Finally, there is the cruciform core, which is generally formed from several plates cut and stacked, of one measure per leg and one or two measures per yoke, with cross-shaped cross section. This type of core is used in distribution and power transformers. The construction of this type of core presents a great advantage for power transformers but at low throughput. Their use is recommended only above 2,500 KVA.

Therefore based on the above, it is an object of the present invention to provide a core and coil assembly that complies with all Domestic and International requirements and standards and at the same time presents significant material savings.

It is another object of the present invention to provide a core and coil assembly, which, when incorporated in a transformer, significantly improves the evaluated price thereof by considerably reducing the no-load losses and load losses.

SUMMARY OF THE INVENTION

In a preferred embodiment of the invention a Wescore type core for a transformer is characterized in that the wounded steel strip forming said core body present differences in height so that a straight or progressive slope is formed defining one or more inclined or curved walls. The slope is such that the cross section area of the joining of two adjacent cores is an octagon, hexagon or even an oval or circle.

In a second embodiment of the invention a toroidal-type core for a transformer is disclosed, characterized in that the wound steel strip forming the core body presents a gradual decrease in its width so that a straight and progressive slope is formed defining one or more inclined or curved walls. The width decrease is such that the cross section area of the toroidal-type core is an octagon, hexagon or even an oval or circle.

DESCRIPTION OF THE PREFERRED EMBODIMENTS

Figure 1:
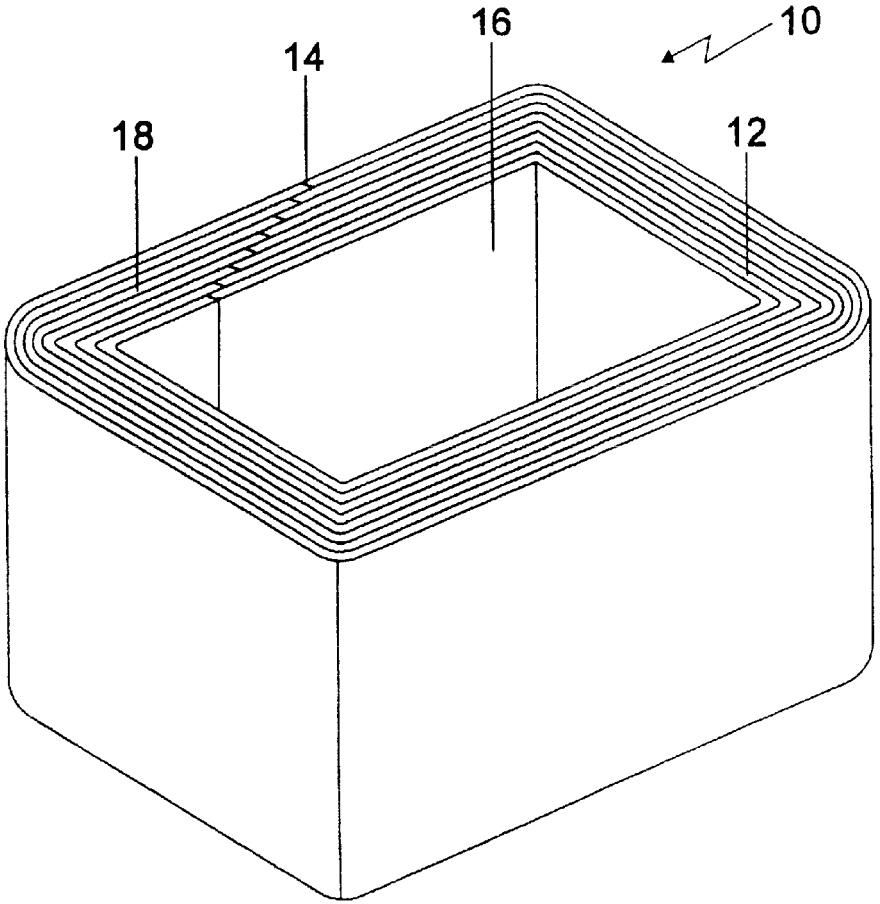
FIG. 1 is a perspective view of a core for a Wescore type transformer of the state of the art.

FIG. 1 show a core for a Wescore type transformer 10 of the state of the art, wherein there are a plurality of rectangular strips 12, which have a plurality of respective transverse cuts 14, together forming a rectangular shaped core which can be disassembled, then, reassembled with a coil around the same. As shown, core internal walls, for example the top wall 16, form a right angle with the core upper walls, for example the top wall 18, i.e., all core sheets present an equal height.

Figure 2:
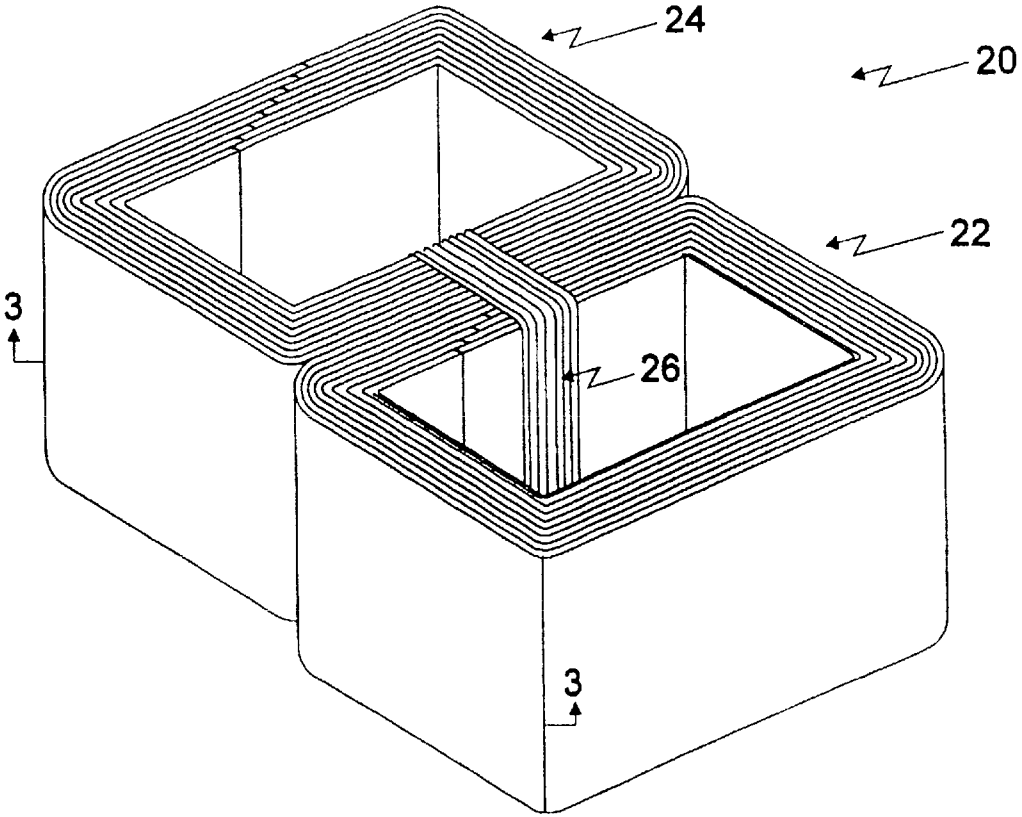
FIG. 2 is a perspective view of a core assembly for a Wescore type transformer, partially wound, of the state of the art.

In FIG. 2 an assembly 20 of two cores for a Wescore type transformer 22, 24 is depicted, joined by a winding 26, which is shown partially for illustrative purposes only.

Figure 3:
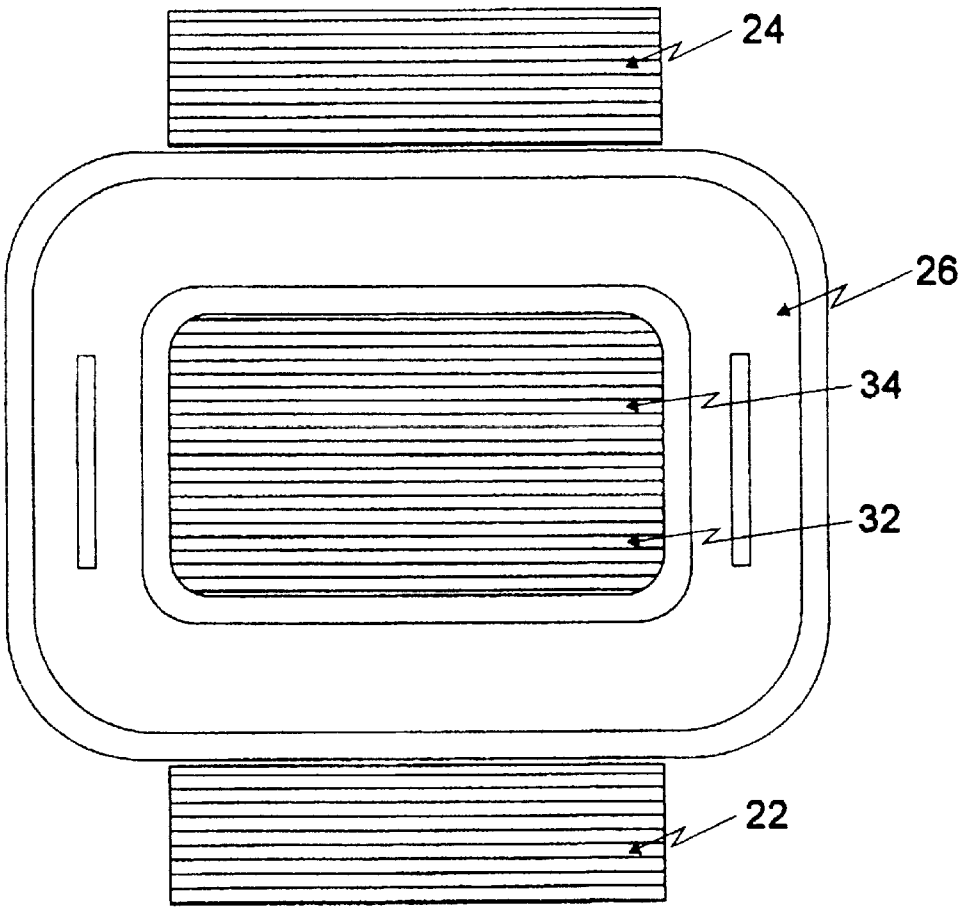
FIG. 3 is a cross section view of a core assembly for a Wescore type transformer and coil of the state of the art, taken along line 3—3 of FIG. 2.

FIG. 3 is a cross section view taken along line 3—3 of FIG. 2, where the winding 26 joins two walls 32, 34 of cores 22, 24, respectively.

Figure 4:
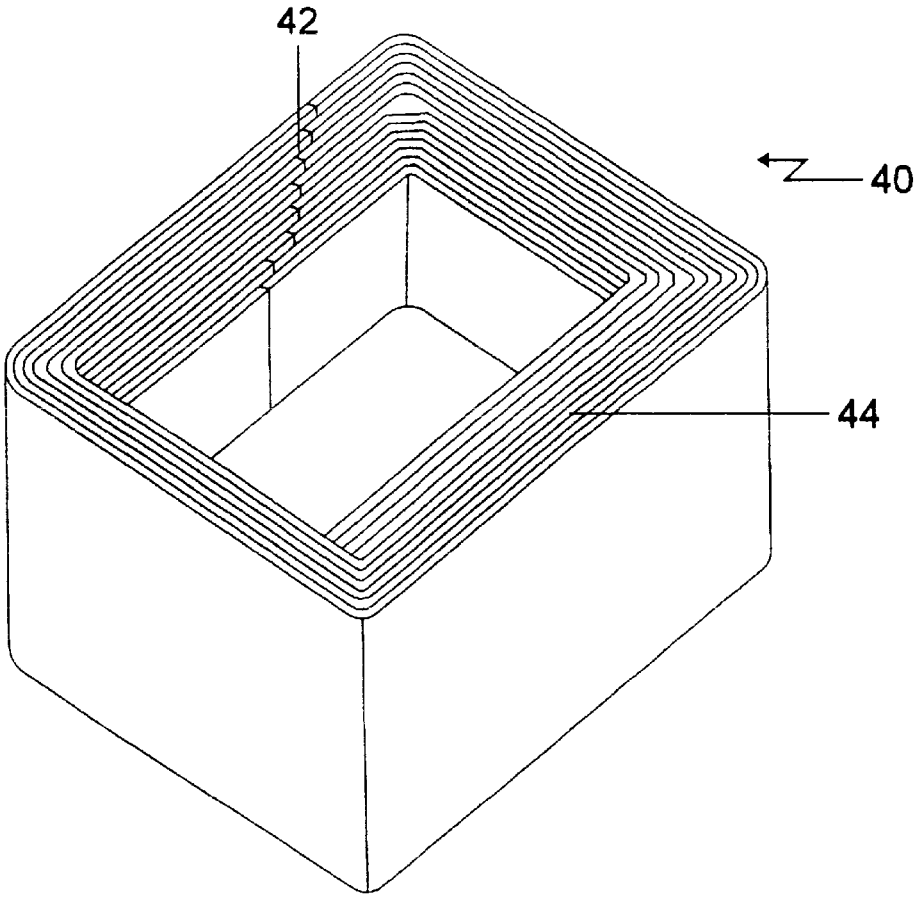
FIG. 4 is a perspective view of a core for a transformer according to the present invention.

FIG. 4 illustrates a core 40 for a transformer according to the present invention, in which the upper wall 42 of core 40, consists of a plurality of strips 44, whose height is such, that top wall 42 of the same forms an angle other than a right angle with the core external and internal faces. In this way, there is a gradual decrease in the sheets height, from the outermost to the innermost, forming an inclined upper wall section 42 that joins the external and internal walls with a predetermined inclination angle.

Figure 5:
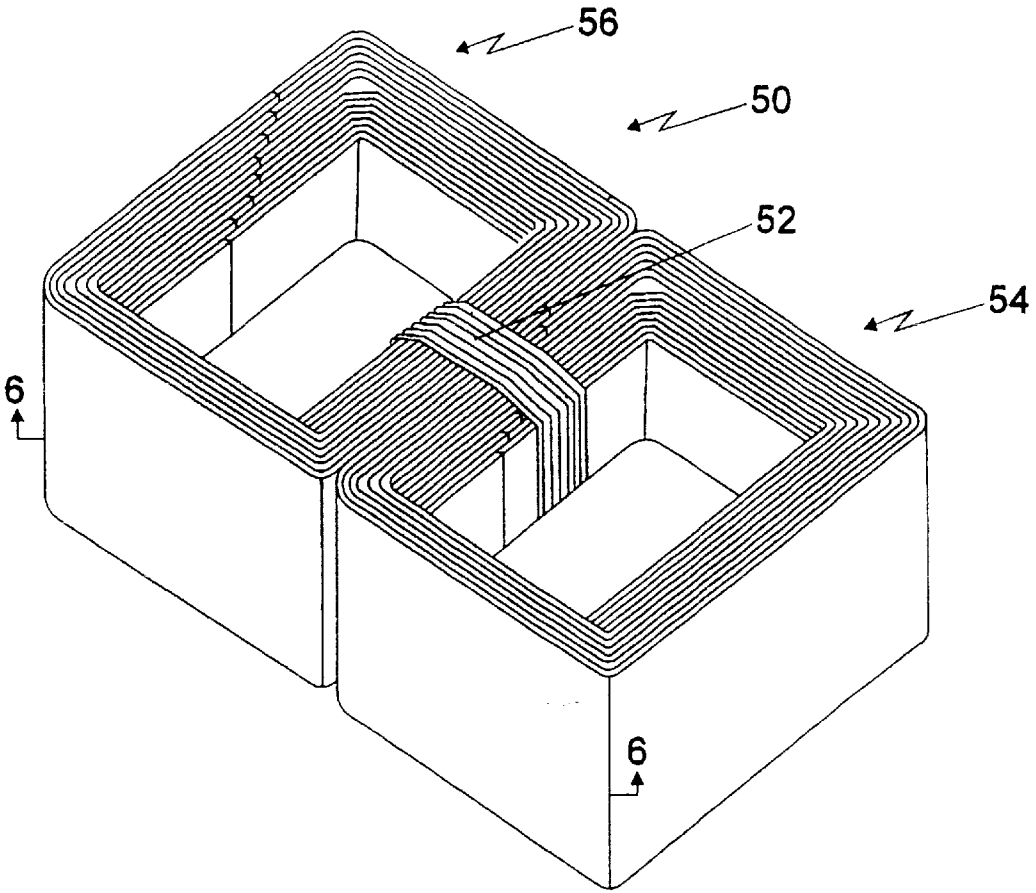
FIG. 5 is a perspective view of a core assembly for a transformer, partially wound, of the present invention.

The upper wall section inclination angle is performed such that, when joining two cores to assemble the corresponding winding, such as shown in FIG. 5, a cross section area is formed that can be varied in accordance with the transformer design. The cross section area may be, in this way, octagonal such as shown in FIG. 6, or it can adopt other shapes such as hexagonal, rectangular with rounded corners or even an oval or circle.

In this way, coil 52 mounted around assembly of cores 50 is accommodated in a more efficient manner, since such coil can be shaped in a closer form to the core, without a right angle in the change of direction of the conductor.

Coil 52 must have about the same pattern as core cross-section, observing the tolerances specified for the type of design.

Figure 6:
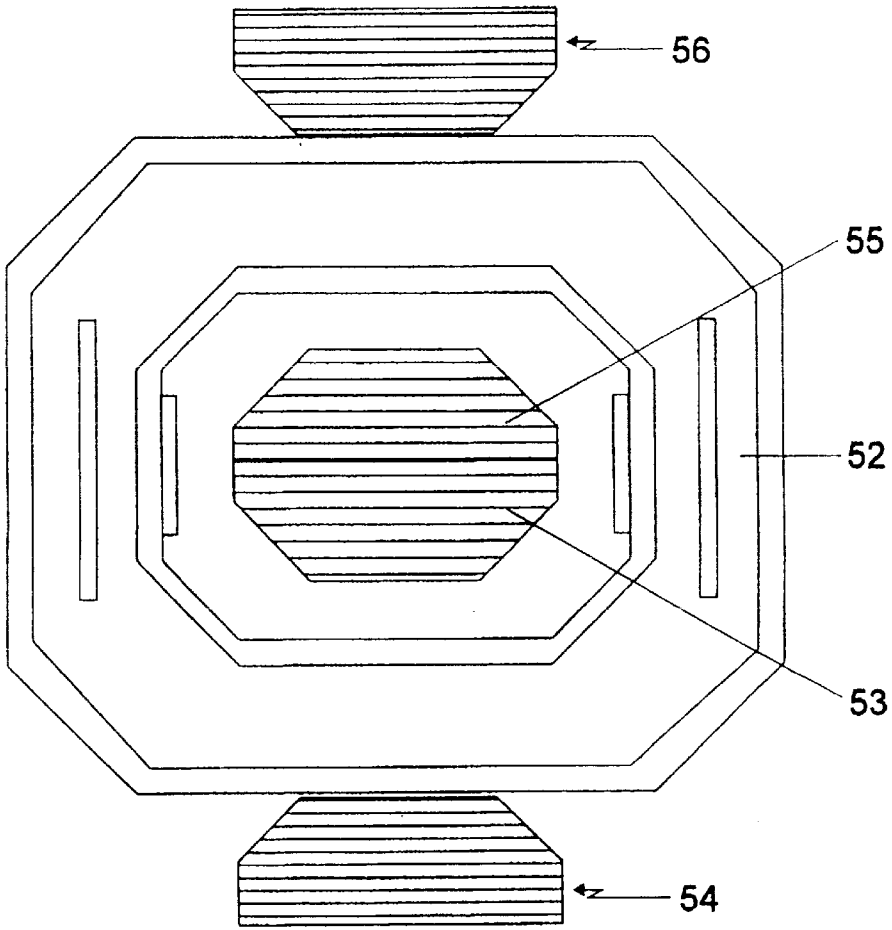
FIG. 6 is a cross section view of a core assembly for a transformer and coil of the present invention, taken along line 6—6 of FIG. 5.

Without the necessity for a mathematical analysis, it is known that the perimeter of a rectangle forming the cross section of two cores joined to form a core assembly in a single-phase transformer, is greater than the perimeter of an octagon, being the illustrated form of the core assembly of the present invention in FIGS. 5 and 6.

Accordingly, the length of coil conductors is shorter and therefore electrical losses of the transformer are also smaller. Likewise, the core area is reduced, thus obtaining an increase in magnetic density and therefore, in no-load losses, thus some parameters are modified to compensate the area and thus to obtain a decrease in no-load losses. That is why the inclined wall section size is calculated in such a way that the minimum cost of materials and less electrical losses are obtained.

As the slope of wall 42 of core 40 increases, the behavior of main parameters is as follows:

Losses in windings are reduced;

Magnetic density increases, if the area eliminated from the core corners is not compensated;

Cost of transformer is reduced;

No-load losses are increased, being the parameter limiting the desirable behavior of the three above points, as it plays a very important role for the economic evaluation of the transformer.

From all of the foregoing, it is clear that the present invention presents the following advantages:

Direct benefit in savings from coil materials, which can be up to 13%, and including the low voltage copper or aluminum strip, the insulating paper placed between layers, and the low-high voltage section insulator;

Electrical losses are reduced, due to the length of winding wires being shorter, thus obtaining a reduction up to about 4%;

Transformer operates in a more efficient manner by reducing the losses;

A considerable increase in the ability to resist the mechanical stresses produced by the short circuit test, Construction tolerances of core-coil assembly are smaller by almost 50%, thus obtaining an additional material saving, Transformer operation temperature has a decrease of from 1 to 20° C., approximately, since there is a greater uncovered surface between the coils and the core, The transformer useful life is lengthened as a result of the decrease in the operation temperature;

A small decrease in tank size, generated by loss reduction and whose immediate effect is less amount of insulating liquid;

In addition to benefits obtained in the transformer cost, the evaluated price is smaller since losses are smaller, which is reflected in less energy consumption (electricity) achieving a very important economic saving in fuel in the generating power station and the associated ecological benefit.

On the other hand, since coils do not have a right angle but small curves of 45° or smaller angles, they do not tend to bow to the window center such as occurs with conventional coils. In case of conventional coils, if it is desired to avoid this effect, it is necessary to include a press process in oven, which takes labor, time and energy.

Figure 9:
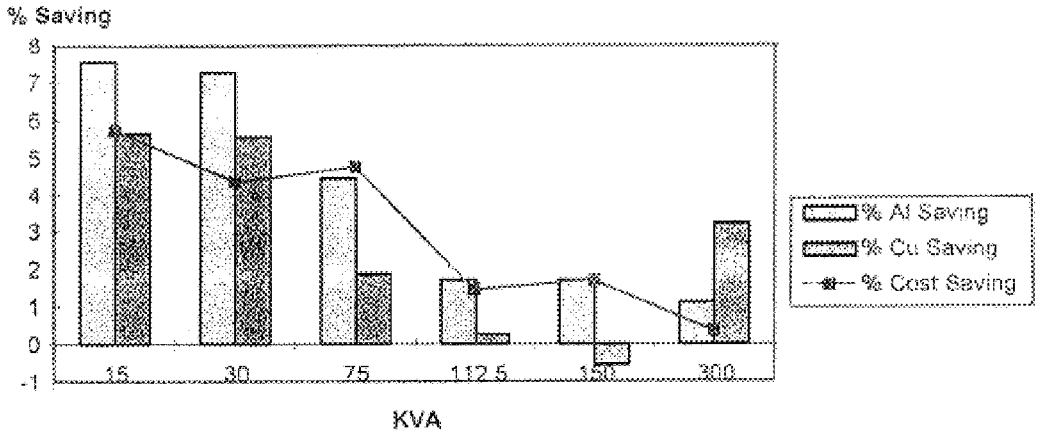
FIG. 9 is a graph showing comparative manufacturing costs for conventional transformers and transformers according to the invention.

13,200 volts three-phase transformers in high voltage and 440Y/254 in low voltage manufactured with core-coil assemblies of the present invention were evaluated as to cost of manufacture. The results are shown in FIG. 9, in which it can be seen that the total saving, depending on the power, goes from about 6% to about 0.5%. For the specific case of a 15 KVA transformer, a saving of approximately 7.57% in aluminum and approximately 5.65% in copper is obtained, with a total saving of about 5.8%.

Figure 10:
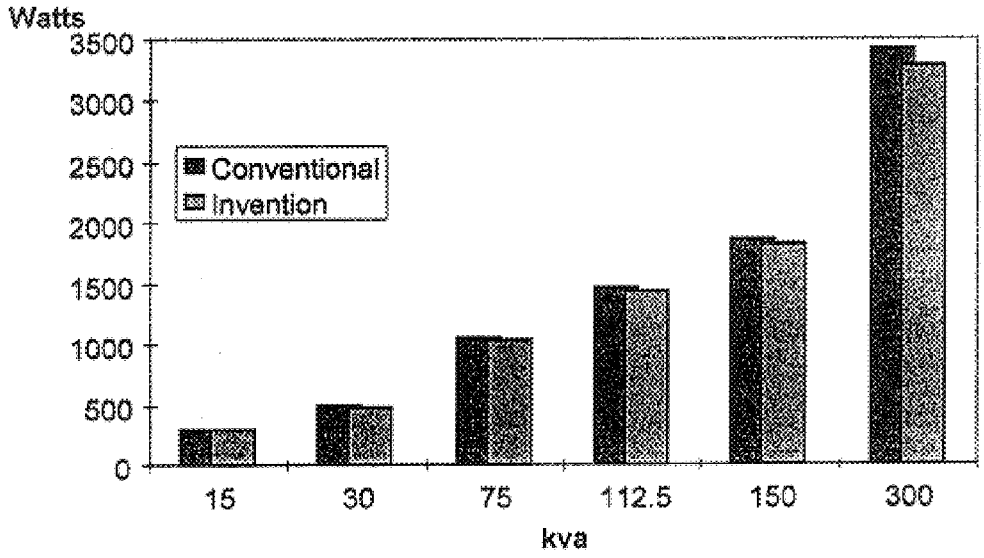
FIG. 10 is a graph showing comparative total electric losses for conventional transformers and transformers according to the invention.

FIG. 10 shows the total electrical losses in a comparative form for a transformer with a conventional core-coil assembly and one of the present invention. As can be seen, losses using a core-coil assembly of the present invention reaches up to approximately 4% for transformers of 300 KVA.

Figure 11:
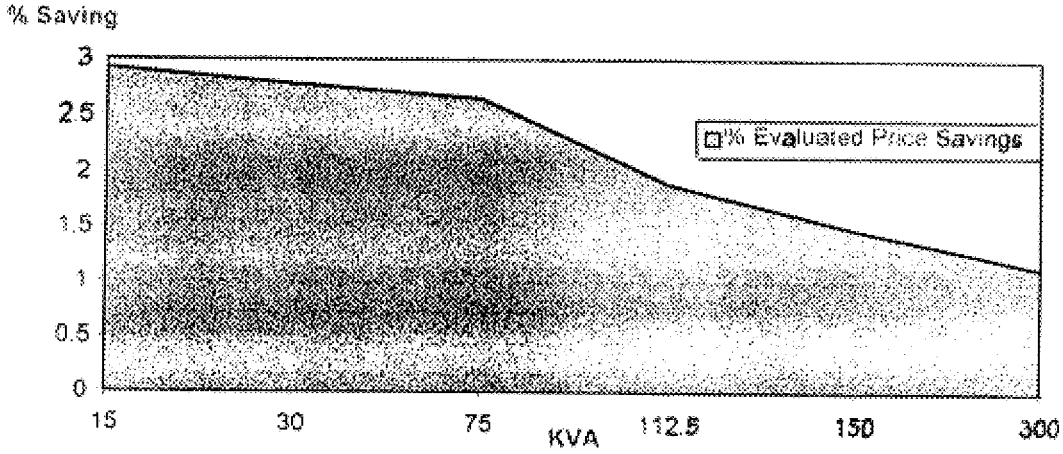
FIG. 11 is a graph showing comparative evaluated prices for conventional transformers and transformers according to the invention.

In summary, the evaluated price of a transformer manufactured according to the present invention is smaller, up to 3%, compared with a transformer of the state of the art, as can be seen in FIG. 11.

Figure 7:
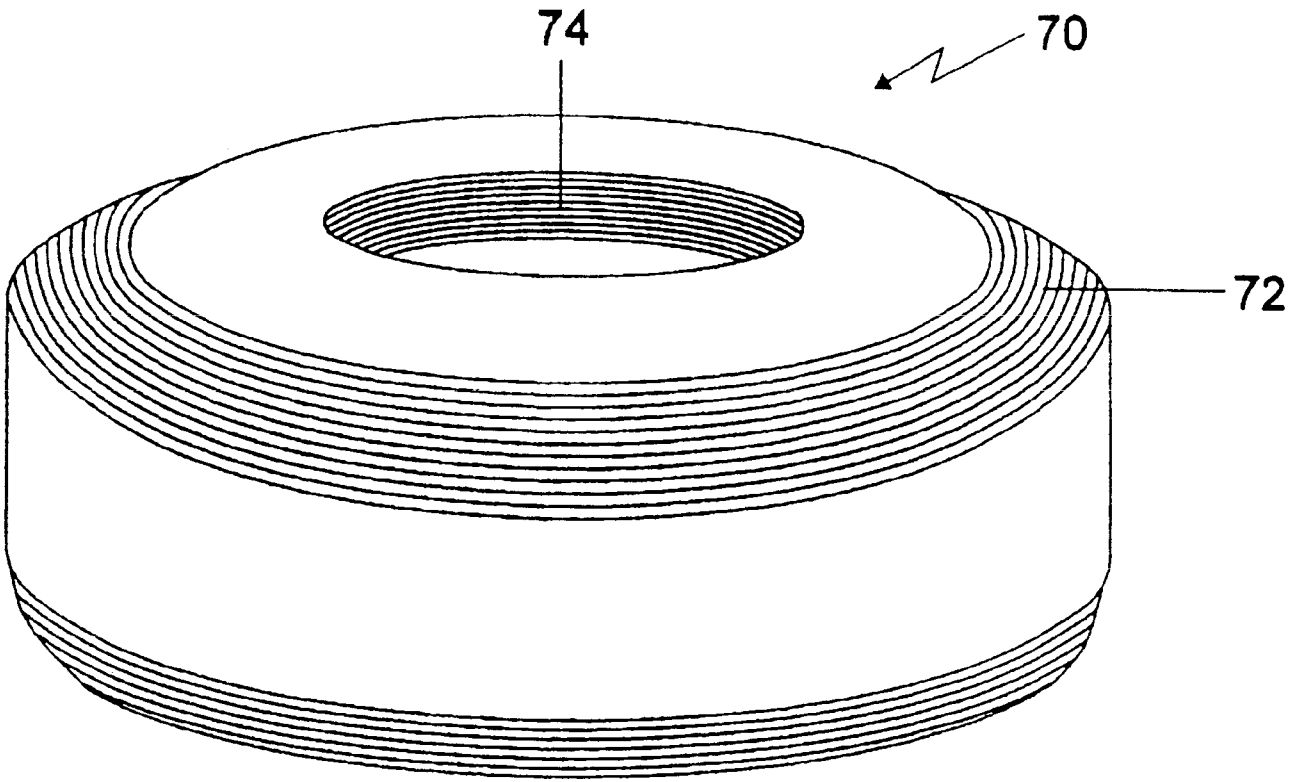
FIG. 7 is a perspective view of a core for a toroidal-type transformer according to the present invention.

In a second embodiment of the invention, it is possible to manufacture a toroidal type core 70 such as depicted in FIG. 7, which has an inclined wall section either on internal wall 72, on external wall 74 or both.

Figure 8:
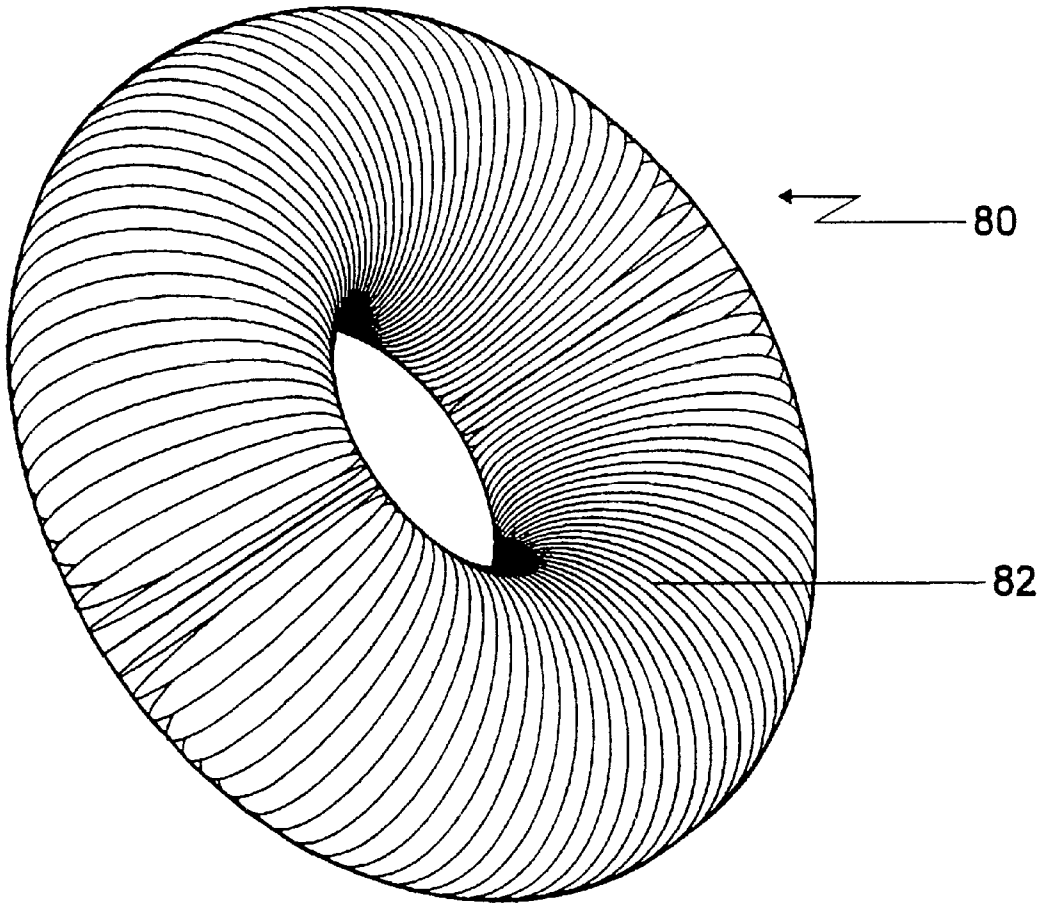
FIG. 8 is a perspective view of a core for a toroidal-type transformer, partially wound, of the present invention.

Toroidal type core 70 presents further advantages in winding the coil, as can be seen in FIG. 8, since it is substantially easier winding the leads 82 using known generic machines.

The use of the toroidal type core 70 of the present invention improves winding wires' distribution and reduces the amount of material used in each turn of wire, mainly on the low voltage coil that is closer to core. In winding wires on the core of the invention, voids that are formed in a conventional toroidal type core are avoided which are caused by turning at a right angle, in addition the damage caused on the conductor when one forces it to turn at a right angle is also reduced.

Advantages of the toroidal type core of the present invention over conventional toroidal type cores are the same as those above discussed for rectangular core of the present invention.

Figure 12:
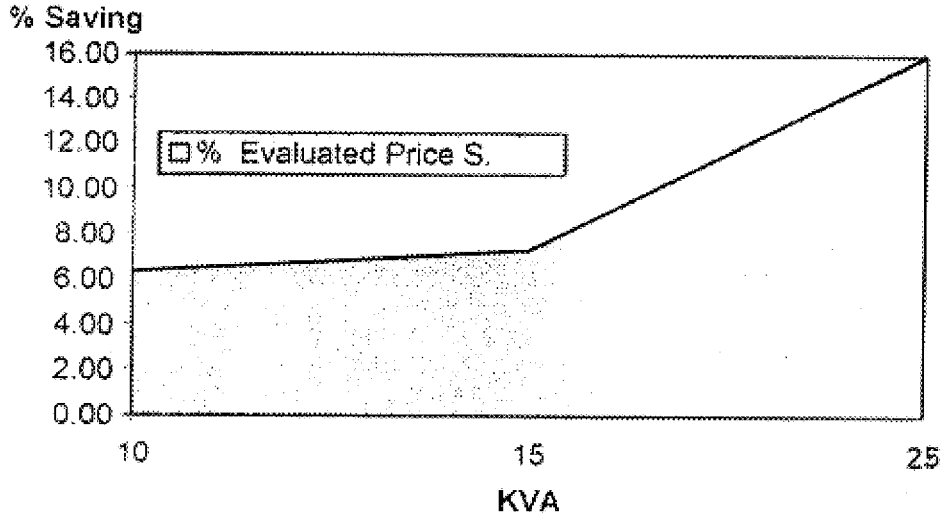
FIG. 12 is a graph showing comparative evaluated prices for conventional transformers and transformers according to the invention.

13,200 volts high voltage single-phase transformers and 120/240 in low voltage transformers manufactured with toroidal type cores of the present invention were evaluated against conventional transformers as to the evaluated price, i.e., cost of manufacturing plus losses, as defined above. Results are presented in FIG. 12, where it can be seen that total savings, depending on power, goes from about 6% up to about 16%.

Figure 13:
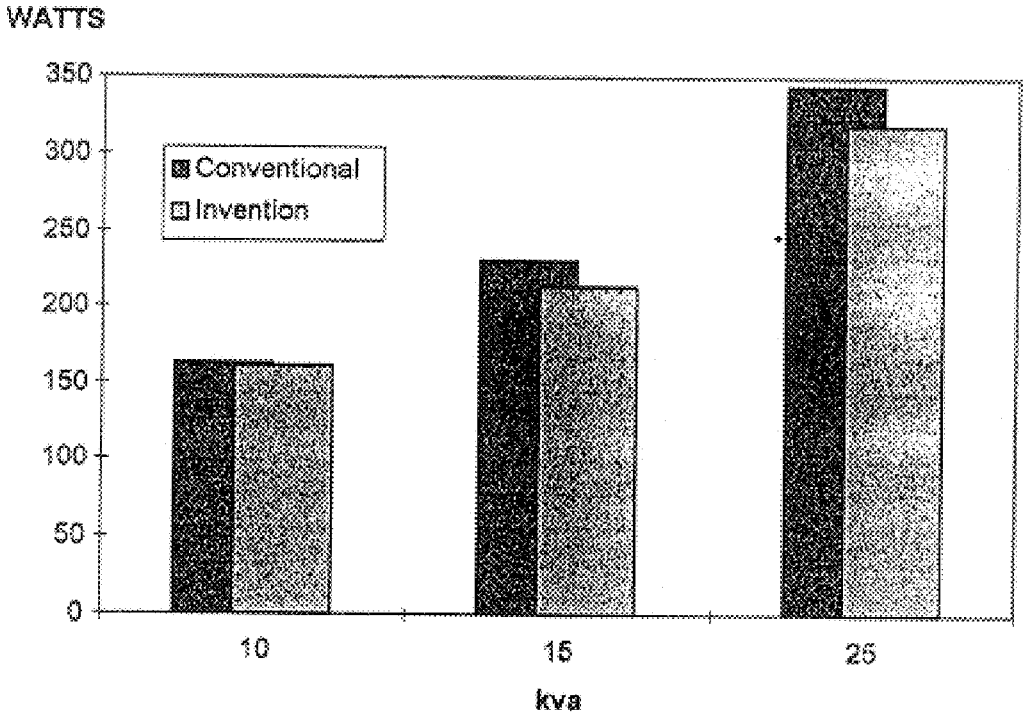
FIG. 13 is a graph showing comparative total electric losses for conventional transformers and transformers according to the invention.

FIG. 13 shows the total of electrical losses in a comparative form for a transformer with conventional core—coil assembly and those of the present invention. By comparing the electrical losses of toroidal type core of the present invention with conventional transformers there are savings of up to 7.19% in 15 KVA transformers.

Figure 14:
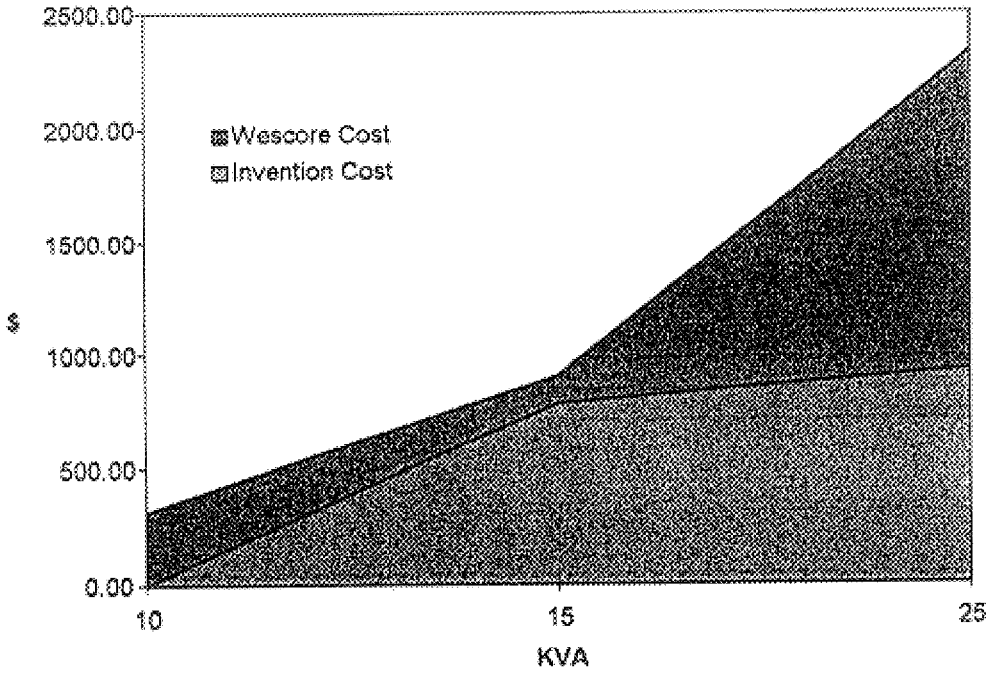
FIG. 14 is a graph showing comparative total costs for conventional transformers and transformers according to the invention.

It is important to mention that there exist large differences in costs between Wescore type transformers and toroidal type transformers, being the toroidal type transformers being more inexpensive. This comparison is shown in FIG. 14.

In summary, total cost of a transformer manufactured according to the present invention is less than those to manufactured according the state of the art.

From the previous description it should be evident for those skilled in the art that it is possible to make changes or modifications falling within scope and spirit of the present invention, according to the following claims.

What is claimed is:

1. A Wescore type core for a transformer characterized in that the wound strips forming said core present differences in their heights so that a straight or progressive slope forms a pattern defining one or more inclined or curved walls.

2. The Wescore type core for a transformer according to claim 1, wherein said slope is such that the cross section area of two adjacent cores joined together is an octagon.

3. The Wescore type core for a transformer according to claim 1, wherein said slope is such that the cross section area of two adjacent cores joined together is a hexagon.

4. The Wescore type core for a transformer according to claim 1, wherein said slope is such that the cross section area of two adjacent cores joined together is an oval or circle.

5. A coil for a Wescore type transformer, characterized in that it is coiled following said pattern of the inclined or curved walls of the core of claim 1.

6. A Wescore type core according to claim 1 further comprising a coil assembly ford transformer that comprises ea core and a coil that is coiled following said pattern of said inclined or curved walls.

7. A toroidal type core for a transformer, characterized in that a wound strip forming a core presents a gradual reduction in width in such a way that a straight or progressive slope is formed defining one or more inclined or curved walls.

8. The toroidal type core according to claim 7, wherein such reduction in width is such that the toroidal type core cross section area is an octagon.

9. The toroidal type core according to claim 7, wherein such reduction in width is such that the toroidal type core cross section area is a hexagon.

10. The toroidal type core according to claim 7, wherein such reduction in width is such that the toroidal type core cross section area is an oval or circle.

11. A toroidal type core and coil assembly for a transformer, characterized in that comprises a core according to claim 7 and one or more coils wound thereon.

* * * * *